US005738084A

United States Patent [19]

Hussong

[11] Patent Number: 5,738,084

[45] Date of Patent: Apr. 14, 1998

[54] VENTLESS PATIO FIREPLACE

[75] Inventor: Dudley D. Hussong, Lakefield, Minn.

[73] Assignee: Hussong Manufacturing Co., Inc., Lakefield, Minn.

[21] Appl. No.: 547,495

[22] Filed: Oct. 24, 1995

[51] Int. Cl.[6] ..... F24C 3/00

[52] U.S. Cl. ..... 126/512; 126/503; 126/528; 126/99 R; 126/116 A; 431/88

[58] Field of Search ..... 126/512, 503, 126/528, 529, 99 R, 116 A, 116 B, 85 R; 431/12, 84, 64, 65, 74, 88

[56] References Cited

U.S. PATENT DOCUMENTS

| | | | |
|---|---|---|---|
| 962,752 | 6/1910 | Dudgeon . | |
| 3,169,519 | 2/1965 | Aizawa et al. | 431/88 X |
| 3,817,686 | 6/1974 | Quittner | 431/125 |
| 4,285,327 | 8/1981 | Buckner et al. | 126/143 |
| 4,415,329 | 11/1983 | Dodd | 431/88 |
| 4,588,371 | 5/1986 | Nakamura et al. | 126/93 X |
| 4,718,846 | 1/1988 | Oguri et al. | 431/76 |
| 4,793,322 | 12/1988 | Shimek et al. | 126/503 X |
| 4,886,445 | 12/1989 | Richardson | 431/125 |
| 5,044,353 | 9/1991 | Mizuno et al. | 126/91 A |
| 5,054,468 | 10/1991 | Moon et al. | 126/512 |
| 5,139,011 | 8/1992 | Moon | 126/512 |
| 5,421,321 | 6/1995 | Ward | 126/519 |
| 5,479,915 | 1/1996 | Riener | 126/503 X |
| 5,575,274 | 11/1996 | DePalma | 126/512 |

*Primary Examiner*—Larry Jones

*Attorney, Agent, or Firm*—Westman, Champlin & Kelly, P.A.

[57] ABSTRACT

An unvented patio fireplace comprises a fireplace housing that has a front panel configured like an in room fireplace, and which fireplace housing is mounted onto a pedestal and base support for movement along a surface. The base support includes wheels and casters as desired for providing mobility. The base also supports a self contained fuel supply for supplying gas to a burner in the fireplace housing. Burner controls include an oxygen depletion sensor so that the unit can be unvented, and tilt sensors that will sense when the fireplace is tilted a selected amount to shut off the gas supply.

13 Claims, 4 Drawing Sheets

VENTLESS PATIO FIREPLACE

BACKGROUND OF THE INVENTION

The present invention relates to a totally self-contained, portable gas burner fireplace unit for use on patios, porches, and other areas for atmosphere and supplemental heat.

Ventless gas burner fireplaces are known, and they normally will include a gas burner inside a fireplace insert that is placed into a regular, fixed installation fireplace.

A self-contained and portable gas burner fireplace provides a substantial step forward in auxiliary heating and the ability to have such auxiliary heat in any desired location, such as on a patio or porch, with the attractive appearance of a fireplace.

SUMMARY OF THE INVENTION

The unvented, gas burner, portable fireplace of the present invention has an outer fireplace configuration for appearance and atmosphere purposes, and is mounted on a pedestal and base that in turn is mounted on wheels and casters so that it can be moved. The pedestal includes a support for a liquid petroleum tank used for the fuel source for the burner. The fireplace configuration includes an opening to a combustion chamber, and includes a screen for the opening, with an efficient gas burner, together with light weight fiber logs covering the gas burner which give the appearance of an authentic wooden log. The fireplace unit has an oxygen depletion sensor pilot control assembly that is used as a shut off in case of oxygen depletion. The fireplace includes level sensors which will cut off the burner in case the fireplace is tipped. A fan can be used to force heated air through suitable passageways and across a room. The fan takes air in at the bottom of the fireplace, along heat exchange passageways at the back and sides of the combustion chamber of the fireplace. The heated air is forced out of the ducts at the top and the front of the fireplace.

The burner used is a highly efficient gas burner heating unit, housed in a fireplace style housing, using a self-contained gaseous fuel supply that burns clean, gives substantial heat, and can be controlled for insuring proper operation without the need for a vent. This makes it portable, and the use of wheels or casters permits it to be moved to desired locations within reach of ordinary extension cords for home electric power. The fireplace can be moved on its wheels even while it is in operation.

DETAILED DESCRIPTION OF THE PREFERRED EMBODIMENTS

Figure 1:
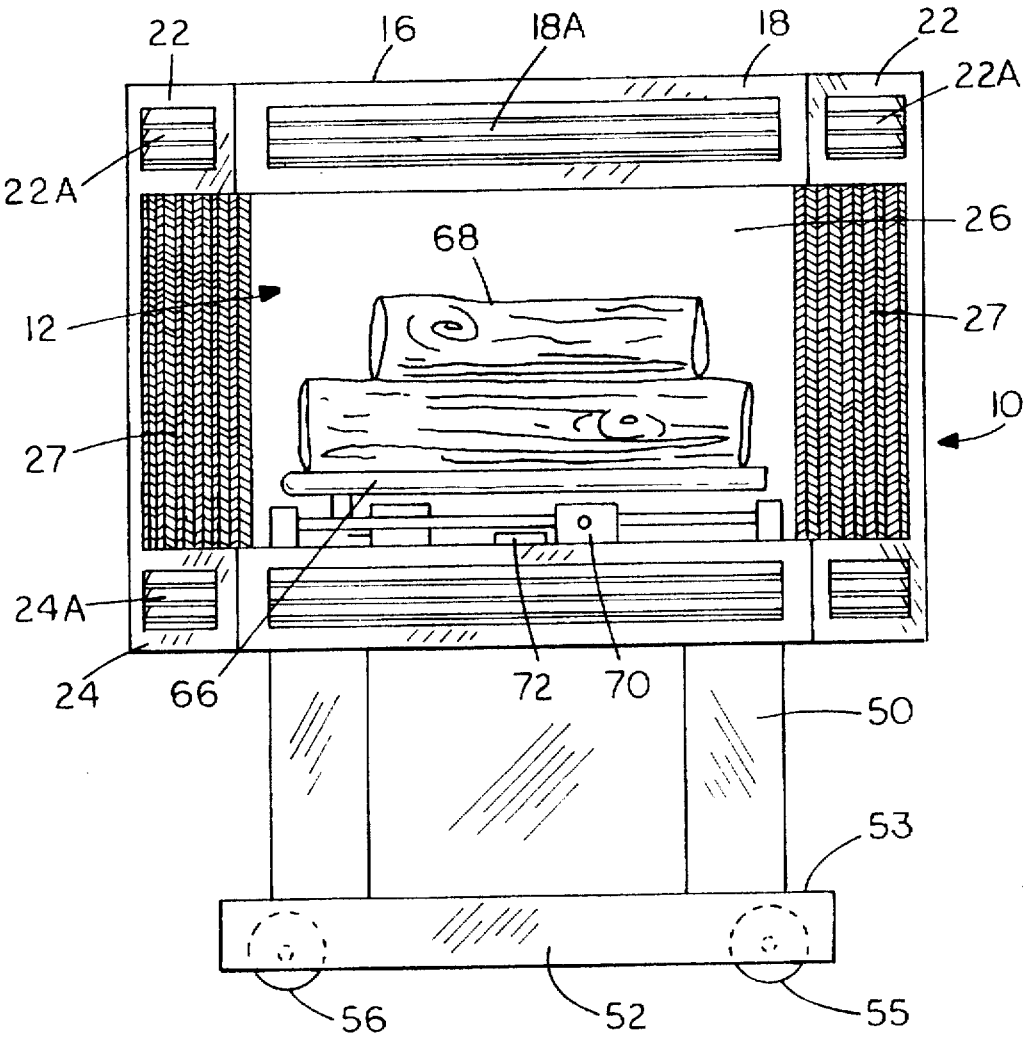
FIG. 1 is a front elevational view of a vent-free fireplace made according to the present invention.
Figure 3:
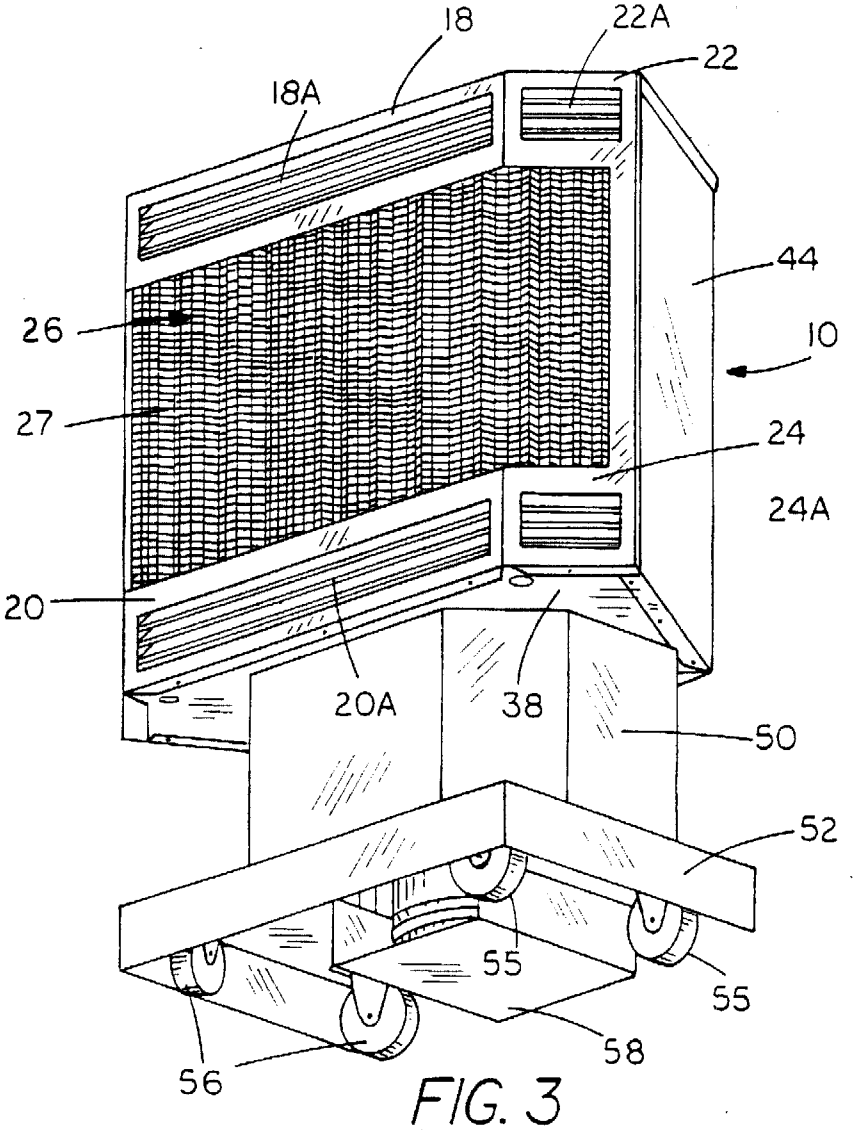
FIG. 3 is a front, bottom perspective view of the vent-free fireplace of FIG. 1.

A vent-free fireplace indicated generally at 10 is formed to be portable, that is, moveable about a room or floor, and includes a fireplace front shown at 12, which forms an attractive, fireplace configuration. A main fireplace housing 14 has a top wall 16, a top front panel 18, a lower front panel 20, and angled front top corner panels 22 which join the top panel 18, and angled front lower corner panels 24 which join the lower front panel 20.

The front panels have suitable air circulation grills 18A, 20A, 22A and 24A installed.

A fireplace screen 27 is supported on a track 29 for sliding along the track to screen the opening 26. The opening 26 can be covered with glass doors, as well.

The fireplace opening 26 opens leading to a combustion chamber 28 defined by a combustion chamber floor 30, a combustion chamber rear wall 32, a combustion chamber top wall 34, and combustion chamber side walls 36. The housing 14 of the fireplace 10 also includes a bottom wall 38 spaced from the combustion chamber floor 30, a housing back wall 40 that is spaced from the combustion chamber rear wall 32, and the housing top wall 16 is spaced from the combustion chamber top wall 34. Additionally, the housing 14 has side walls 44 which are spaced from the combustion chamber side walls 36. The space between the combustion chamber walls and the housing walls forms a pathway for air circulation. The flow pathway includes a lower portion 46 that is below the combustion chamber 28, and a flow pathway 48 along the back wall, and a flow pathway, 49 along the sides of the combustion chamber 28. The pathways in turn connect to a top flow path 47 which leads to the air outlet grills 18A and 22A in the top panels 18 and 22. The inlet air comes in through the grills 20A and 24A that are in the bottom front panels 20 and 24 and then through the pathway 46.

The fireplace 10 is supported on a pedestal 50, which in turn is mounted on a mobile base 52. The base 52 has a top platform 53, and a skirt around three sides of the platform 53 to provide strength and also to shield from view a pair of support wheels 55, and a pair of casters 56 that permit movement of the base 52. Thus the fireplace 10 can be moved from place to place along a supporting surface. The wheels 55 can be fixed axis wheels of suitable design, and the wheels 56 are casters as shown so the fireplace can be easily wheeled about.

Figure 2:
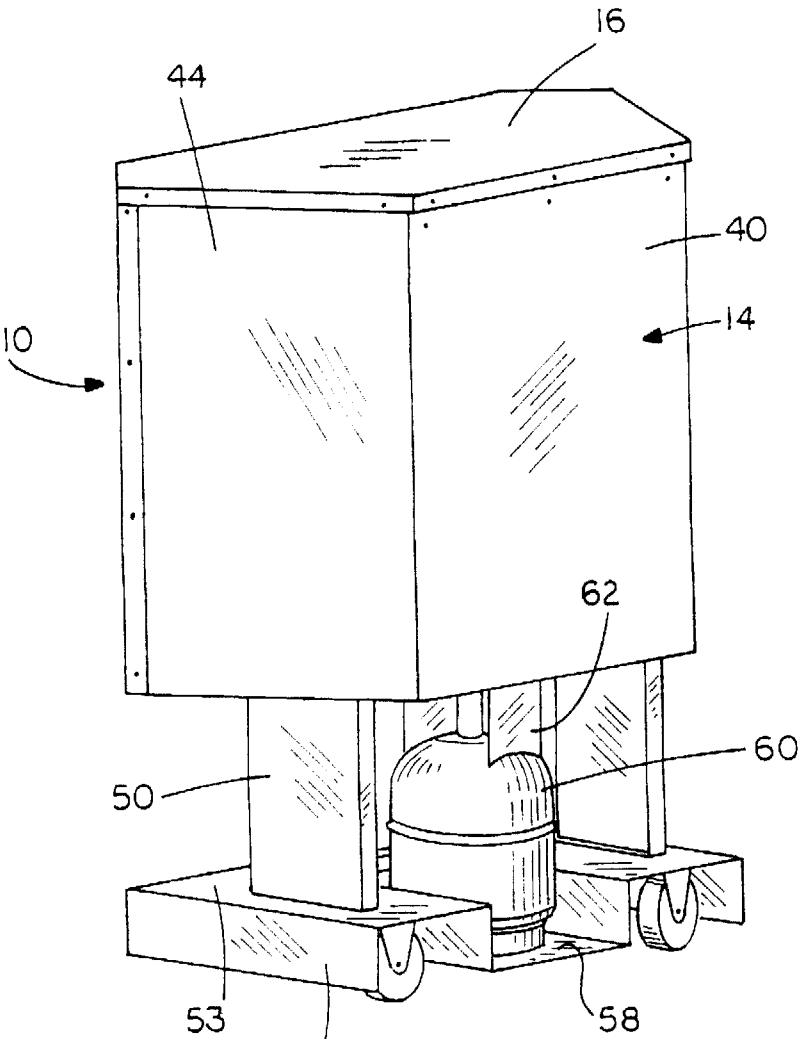
FIG. 2 is a rear perspective view of the vent-free fireplace of FIG. 1.

As can be seen in FIG. 2, the base 52 has a support shelf section 58 that is part of the platform 53, but which is recessed down so that it is quite close to the support surface. It is not below the skirt 52 around the front and side edges of the platform 53. This recessed shelf is made to support a liquid petroleum (LP gas) tank 60. The tank can be secured in place in a suitable manner, as shown using a bracket 62.

The fuel tank 60 is connected through a line and suitable controls shown at 64 in FIG. 1, including a regulator 80 to control the flow of gas to a burner 66 on which artificial logs 68 are supported. Additionally, the control for the burner includes an oxygen depletion sensor burner and pilot control 70, also mounted on the front panel. The oxygen depletion sensor burner and pilot control 70 is well known for ventless gas burners, and there are commercial units readily available for controlling the flow of gas to the burner only when the oxygen level in the combustion chamber 28 is adequate to support efficient combustion.

Figure 4:
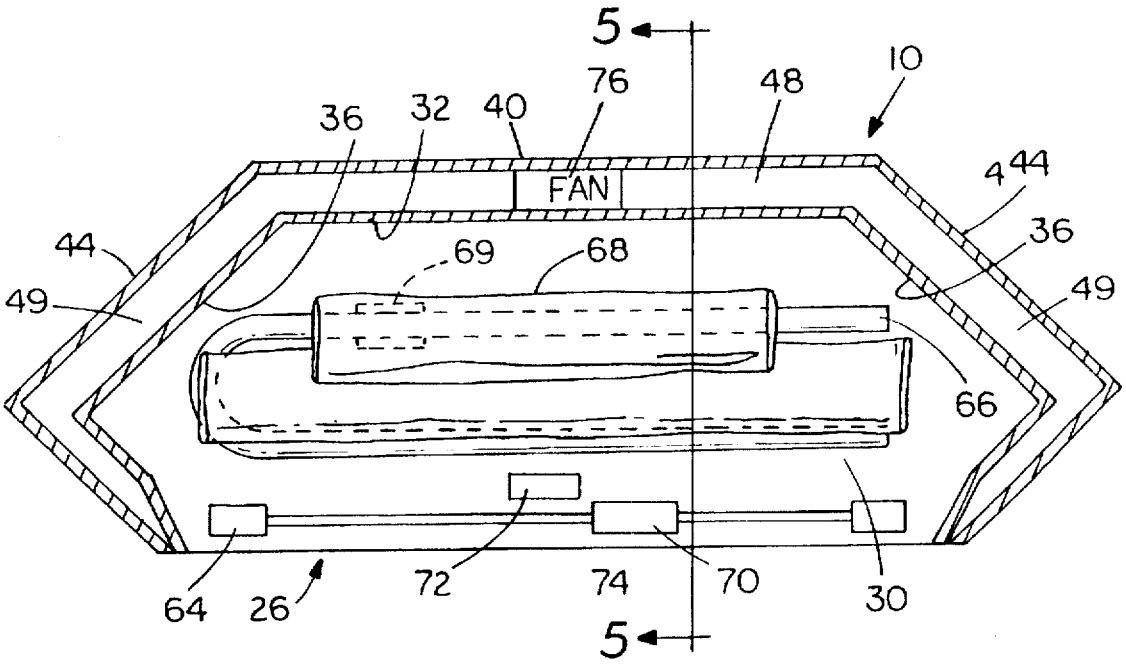
FIG. 4 is sectional view taken generally on lines 4—4 in FIG. 1.
Figure 4A:
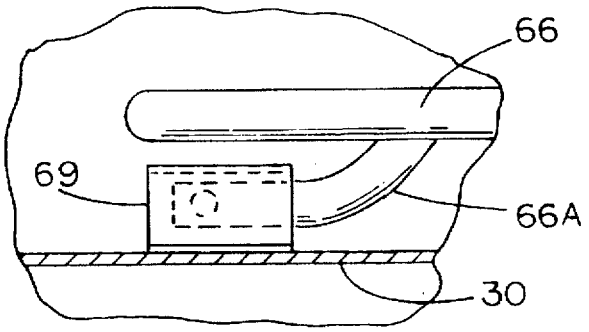
FIG. 4A is a view showing a shield placed to shield a burner air intake orifice.
Figure 4B:
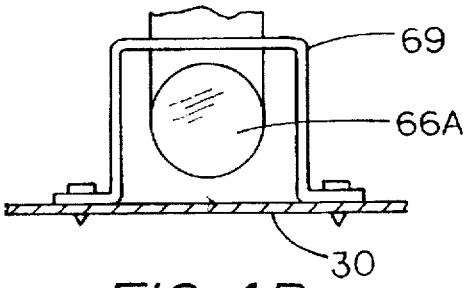
FIG. 4B is an end view of the shield shown in FIG. 4A.
Figure 5:
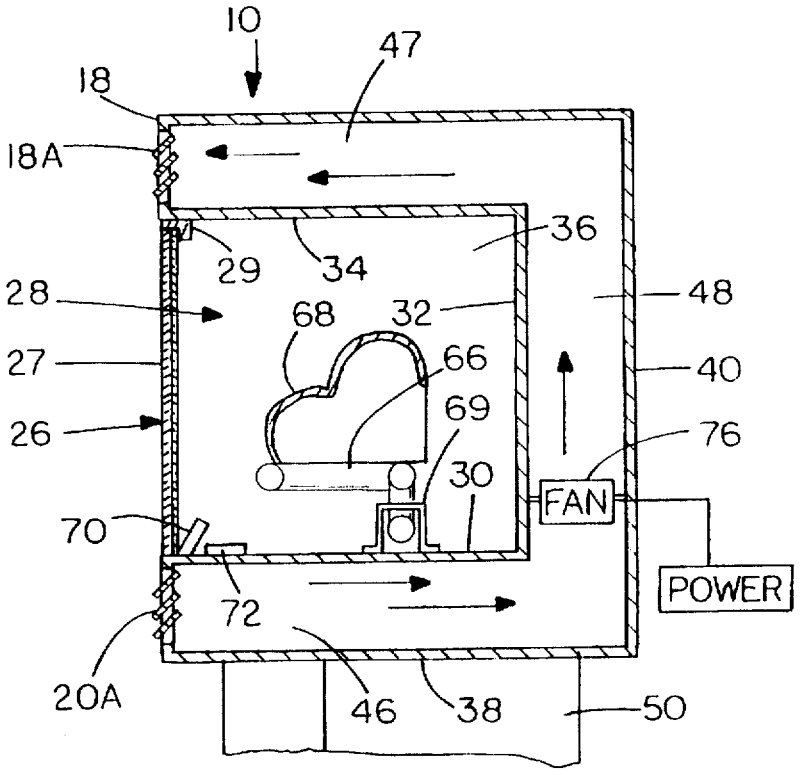
FIG. 5 is a sectional view taken on lines 5—5 in FIG. 4.

The burner 66 has a primary air intake pipe 66A (See FIG. 4A) that has an orifice for burner intake air. A shield 69 is formed over the intake orifice and fastened to the combustion chamber floor 30 to shield the orifice from direct wind through the front opening 26. A wind speed of 10 miles per hour will not extinguish the burner. The shield can have a different configuration, if desired.

Schematically shown in FIG. 1 is a level sensor indicated at 72 which provides a signal to the burner controls so that if the fireplace 12 is tilted more than 20 degrees from a vertical line or axis, the burner controls will shut off. This is an omni-directional liquid level switch. A suitable switch is one made by Fluid Products Co. Inc. of 14592 Martin Drive, Eden Prairie, Minn. The level sensor 72 senses tilting in any direction from a vertical axis.

The level sensor 72 can be conductive liquid sensors (mercury) which will flow to break contact when the tilting is more than a selected amount. Other types of level sensors also can be utilized. The level sensor shut off will prevent continued combustion at the burner if the fireplace 12 is accidentally tipped when being moved or similar conditions occur.

The passageways 46, 48 and 49 can be used for housing a fan 76, which can be connected to power in a suitable manner through a thermal relay 82 that senses burner operation by suitable coupling. The thermal relay is to make sure that the air in the passageway is adequately warm before the fan 76 turns on. The fan 76 can then be used for circulation of air past the warm rear, top and side walls of the combustion chamber 28. The air exhausted out through the grill 18A in the panel 18 and the grills 22A thus will be heated and can be directed to desired local areas in front of the fireplace 12. The burner regulator 80 controls the heater to maintain room temperature at a set level.

Figure 6:
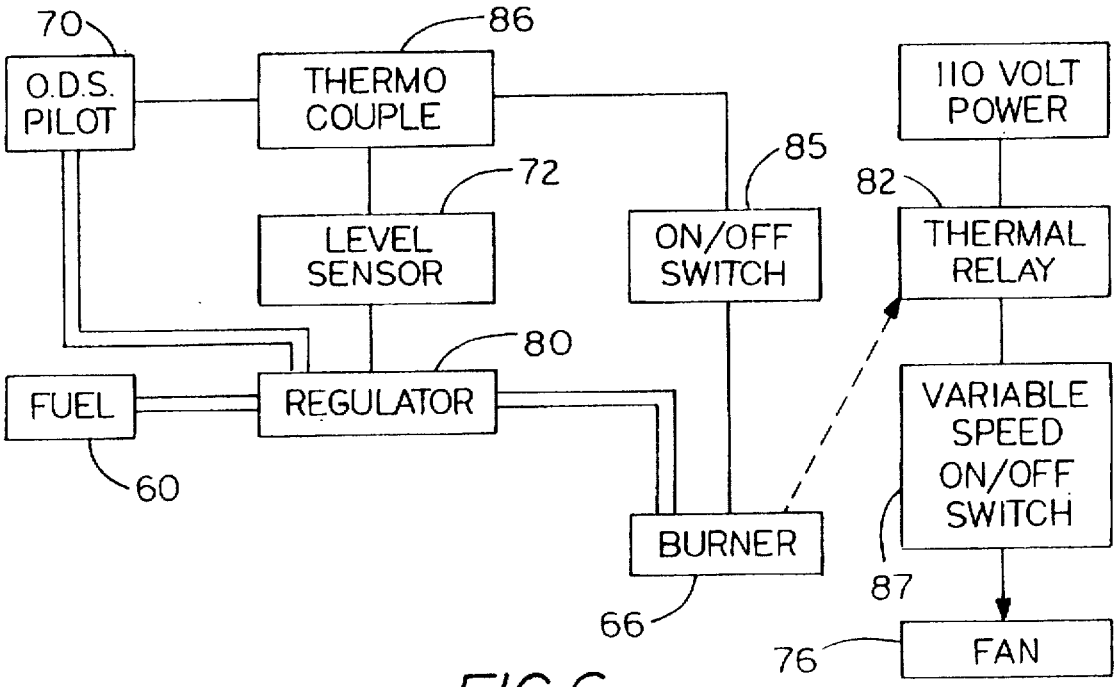
FIG. 6 is a simplified schematic circuit diagram of typical controls of the present invention.

In FIG. 6 a schematic showing is provided. The fuel is fed through a conventional regulator 80 to burner 66. The oxygen depletion sensor 70 will open a circuit from a thermocouple 86 to shut off regulator 80 and burner 66 if oxygen is depleted. The level sensor 72 is connected in series from a thermocouple 86 to the regulator 80 so if the level switch 72 opens regulator 80 is also shut off. The thermocouple signal is provided in response to pilot light heat. A manual on/off switch 85 is also provided. The fan is connected to power through a thermal relay 82 and a variable speed, on/off switch 87 to control fan 76.

This unit is designed to withstand winds up to 10 M.P.H. by means of a protective shield positioned over the primary air inlet.

The outer housing enclosed the burner and control so that it will withstand down-pouring rain for at least one-half hour without burner or pilot failure. The burner is inset from the front opening sufficient to provide shielding. A drain hole can be provided in the burner compartment if desired.

The fiber logs used in this unit are designed to withstand several hours of rainfall without deterioration or absorption of water. The logs are made of a hi-temp silicone based rigidizing coating or layer absorbed into the log surface.

This unit can be converted to natural gas if so desired, using a quick couple connection available on the market. This is very useful when a natural gas line is run in such places as restaurant patios, or where refueling L.P. tanks are not desired. Flexible line connection can be used so some portability is available.

The fireplace thus provides a highly efficient burner, that is attractive, but is portable and self-contained so that permanent gas connections do not have to be made. The unit will of course work will natural gas of suitable connections and controls are utilized.

Although the present invention has been described with reference to preferred embodiments, workers skilled in the art will recognize that changes may be made in form and detail without departing from the spirit and scope of the invention.

What is claimed is:

1. A portable ventless fireplace comprising a fireplace housing having outer walls;

a combustion chamber defined in said fireplace housing for supporting a burner, the combustion chamber having walls spaced inwardly from the outer walls of the fireplace housing, said combustion chamber walls being heated by the burner, and a fan for circulating air through the space between the combustion chamber walls and the fireplace housing walls;

a support for said fireplace to position the fireplace housing above a supporting surface;

a source of fuel for the burner mounted on the support; and wheels on the support for permitting movement of the fireplace housing along a supporting surface.

2. The fireplace in claim 1 including a sensor for sensing tilting of the fireplace housing for shutting off the burner when the fireplace is tilted more than a predetermined number of degrees from a reference position.

3. The fireplace of claim 1, wherein said combustion chamber walls and fireplace housing walls include top walls that are spaced apart, and air exhaust grills on a forward portion of the fireplace housing covering the space between the combustion chamber top wall and the fireplace housing top wall.

4. The fireplace of claim 1, wherein said support includes a pedestal that supports a bottom wall of the fireplace housing, and a self-contained fuel supply mounted on the support and below the fireplace housing bottom wall.

5. The fireplace of claim 1, wherein the fuel supply is a self-contained said support comprises a pedestal providing a shield for shielding the fuel supply from view.

6. The fireplace of claim 5, wherein said fuel supply comprises a liquid petroleum pressurized gas container.

7. A portable ventless fireplace comprising a fireplace housing;

a combustion chamber defined in said fireplace housing for supporting a gas burner;

a pedestal support for said fireplace housing to position the fireplace housing above a supporting surface;

said support including a base having a support shelf below the fireplace housing;

a gaseous fuel tank for the burner mounted on the shelf and connected to the burner;

a plurality of wheels on the support for permitting movement of the fireplace housing along a supporting surface; and a sensor for sensing tilting of the fireplace housing for shutting off the burner when the fireplace is tilted more than in the range of twenty degrees from a reference position.

8. The ventless fireplace of claim 7, wherein the combustion chamber has walls spaced inwardly from walls forming the fireplace housing, said combustion chamber walls being heated by the burner, and a fan for circulating air through the space between the combustion chamber walls and the fireplace housing walls.

9. The ventless fireplace of claim 8, wherein said combustion chamber walls and fireplace housing walls include top walls that are spaced apart, and air exhaust grills on a forward portion of the fireplace housing covering the space between the combustion chamber top wall and the fireplace housing top wall.

10. The fireplace of claim 7 and an oxygen depletion sensor control for shutting off the burner when oxygen in the combustion chamber is reduced below a desired level.

11. The fireplace of claim 10, wherein the burner has an intake air orifice, and a shield for preventing direct wind from striking the intake air orifice.

12. A portable ventless fireplace comprising a fireplace housing;

a combustion chamber defined in said fireplace housing for supporting a gas burner, the combustion chamber providing a fireplace defined by bottom, rear, top and side walls joined together and having a front fireplace opening, the burner having an intake air orifice, and a shield positioned relative to the intake air orifice and the front fireplace opening to prevent air flowing through the fireplace opening from directly striking the intake air orifice;

a pedestal support for said fireplace housing to position the fireplace housing above a supporting surface;

said support including a base supported for a movement across a supporting surface;

a gaseous fuel tank for the burner mounted on the base and connected to the burner; and an oxygen depletion sensor control for shutting off the burner when oxygen in the combustion chamber is reduced below a predetermined level.

13. The fireplace in claim 12 including a tilt sensor for sensing tilting of the fireplace housing for shutting off the burner when the fireplace is tilted more than in the range of twenty degrees from a reference axis of the tilt sensor, which axis is substantially vertical with the base supported on a supporting surface.

* * * * *